US005810497A

United States Patent [19]

Bachmann et al.

[11] Patent Number: 5,810,497

[45] Date of Patent: Sep. 22, 1998

[54] RESERVOIR, IN PARTICULAR FOR A COSMETIC SUCH AS NAIL ENAMEL OR THE LIKE

[75] Inventors: Günter Bachmann, Neuendettelsau; Norbert Dumler, Ansbach; Werner Fischer, Bruck; Dieter Wolfsgruber, Petersaurach, all of Germany

[73] Assignee: georg karl geka-brush GmbH, Bechhofen-Waizendorf, Germany

[21] Appl. No.: 613,385

[22] Filed: Mar. 7, 1996

[30] Foreign Application Priority Data

Mar. 11, 1995 [DE] Germany ..... 195 08 836.0

[51] Int. Cl.[6] ..... A45D 44/18; B65D 44/04

[52] U.S. Cl. ..... 401/129; 401/126; 215/228; 215/330; 132/313; 206/152; 206/823

[58] Field of Search ..... 215/216, 217, 215/218, 222, 228, 43, 44, 390–392, 329–332; 220/212, 288, 293, 296, 297, 298, 300–302, 735, 736, DIG. 26; 206/581, 229–230, 823, 15.2; 15/167.3, 106–107; 132/73, 313, 317; D28/56, 57; D4/108, 116; D9/337, 338; 401/120, 128, 129, 4, 126

[56] References Cited

U.S. PATENT DOCUMENTS

| | | | |
|---|---|---|---|
| 3,160,269 | 12/1964 | Davidson | 206/15.2 |
| 3,739,933 | 6/1973 | Degaetano | 215/222 |
| 3,944,101 | 3/1976 | Landen et al. | 215/218 X |
| 4,271,974 | 6/1981 | Quinard | 215/331 |
| 4,597,501 | 7/1986 | Gueret | 215/330 |
| 4,605,135 | 8/1986 | Ryder | 215/220 |
| 4,632,240 | 12/1986 | Goncalves | 215/341 X |
| 4,664,273 | 5/1987 | Simon | 215/217 X |
| 4,896,783 | 1/1990 | Leoncavallo et al. | 215/330 |
| 5,072,850 | 12/1991 | Gagnon et al. | 215/332 X |
| 5,145,080 | 9/1992 | Imberry, Jr. | 215/331 |
| 5,160,057 | 11/1992 | Fitjer | 215/331 X |

*Primary Examiner*—Allan N. Shoap
*Assistant Examiner*—Nathan Newhouse
*Attorney, Agent, or Firm*—Browdy and Neimark

[57] ABSTRACT

In a screw cap reservoir, in particular for a cosmetic such as nail enamel, comprising a neck having an external thread on which to screw the internal thread of the screw cap, an encircling shoulder being formed on the neck in the portion below the external thread, this shoulder having at least one stop in the form of a projection which, extending over a certain angle at circumference, projects upwards from the annular shoulder, and stop recesses being provided on the lower edge of the screw cap, which cooperate with the stop projections and which snap-engage with the stop projections when the screw cap is screwed on so that the screw cap is arrested in a defined final position by resistance to return motion, it is provided, with a view to achieving a defined closing condition accompanied by a pronounced click effect, that in a portion approximately above each stop recess, the peripheral surface of the screw cap is provided with a recess tapering the wall thickness or breaching the wall.

10 Claims, 3 Drawing Sheets

RESERVOIR, IN PARTICULAR FOR A COSMETIC SUCH AS NAIL ENAMEL OR THE LIKE

BACKGROUND OF THE INVENTION

1. Field of the Invention

The invention relates to a screw cap reservoir, in particular for a cosmetic such as nail enamel or the like, comprising a neck having an external thread on which to screw the internal thread of the screw cap, an encircling shoulder being formed on the neck in the portion below the external thread, this shoulder having at least one stop in the form of a projection which, extending over a certain angle at the circumference, projects upwards from the annular shoulder, and stop recesses being provided on the lower edge of the screw cap, which cooperate with the stop projections and which snap-engage with the stop projections when the screw cap is screwed on so that the screw cap is arrested in a defined final position by resistance to return motion.

2. Background Art

As a rule, reservoirs of the generic type comprise a closing unit of plastic material and the actual reservoir of glass or any other plastic material. Reservoirs of the generic type serve to take up the most varying products such as for instance drugs or cosmetics.

When the reservoir is used for a cosmetic, in particular for easily volatile substances such as nail enamel, it is important for the user of the reservoir to have the possibility of tactile and audio-visual control, by which to make sure that the reservoir is really closed. To this end, the locking devices are designed in such a way that in addition to the screw cap being reliably arrested in its final position and prevented from return motion, the snap-on operation is audible and tangible.

Simultaneously, it must also be ensured that the closing cap is arrested in a position at a precisely defined angle of rotation relative to the reservoir. Accordingly, the reservoir is frequently conceived such that the outer contours are possibly non-circular and the reservoir and the closing cap are flush or that at least the reservoir and the closing cap exhibit a decoration which is to give a uniform impression in the closed condition.

Finally, there is still another prerequisite consisting in that the inner sealing faces rest sealingly on each other in the closed condition, there being no escape either of liquid or of any other volatile components.

To comply with all these prerequisites, various solutions have been developed, which are however compromise solutions, there being neither the desired click effect nor any sufficiently reliable sealing nor the ease of screwing that would be desirable for the screw cap in particular when handled by women. A substantial reason for the fact that no satisfying results could be attained resides in that the closing member of plastic material can be injection-molded very accurately, but that the reservoirs, in particular when made of glass, exhibit comparatively high tolerances produced in their manufacture.

SUMMARY OF THE INVENTION

It is the object of the invention to embody a screw cap reservoir of the type mentioned at the outset in such a way that in spite of inevitable tolerances, produced in their manufacture of the actual reservoir, a defined closing condition can be achieved between the screw cap and the reservoir, accompanied by a pronounced click effect, with the sealing faces of the cap and reservoir resting on each other rather perfectly.

According to the invention this object is attained in that in a portion approximately above each stop recess on the cap, the peripheral surface of the screw cap is provided with a recess tapering into its wall thickness or through the wall.

Such a recess according to the invention in the form of a hole through the wall of the cap or a tapering into the wall thickness or, as the case may be, in the form of a recess open to the bottom will lead to increased flexibility in the vicinity of the lower edge of the screw cap so that, even though the dimensions of the reservoir may fluctuate within some range of tolerance, the screw-on operation is accompanied by flexible yielding and audible and tangible locking into place of the cap on the reservoir.

In keeping with another embodiment it is provided that the recesses are designed in the way of slits, overlapping the stop recesses in the circumferential direction. By the dimensioning of the recesses, it is virtually possible to concert and set the necessary flexibility in dependence on the plastic material chosen and on the range of tolerance to be expected of the dimensions of the reservoir.

Furthermore, provision can be made for such portion of the lower edge of the screw cap which, during the screw-on operation, will first contact the upper side of the stop protections of the reservoir to be inclined in the direction of the thread pitch. This will help facilitate the beginning of the snap-on process. By advantage, the inclination corresponds to the thread pitch.

Yet another measure for the compensation of tolerances produced in the reservoir may reside in that at least part of the turns of the internal thread of the screw cap are flexible in such a way that a groove will extend radially inwards from the crest of the respective turn, making the thread flank resilient.

If the reservoir is for instance a nail enamel unit, an applicator being provided that has a handle and a retaining attachment snap-engaging with the screw cap, the retaining attachment can be provided with a lower annular shoulder in such a way that upon snap-engagement of the stop recesses with the stop projections, the shoulder rests plane on the front of the mouth of the reservoir, forming a tight assembly. Such a unit can be of one- or two-part design, a click effect being attainable just the same, which has not been possible so far with units of this type.

Further features and details of the invention will become apparent from the ensuing description of preferred exemplary embodiments, taken in conjunction with the drawing.

DESCRIPTION OF THE PREFERRED EMBODIMENTS

Figure 1:
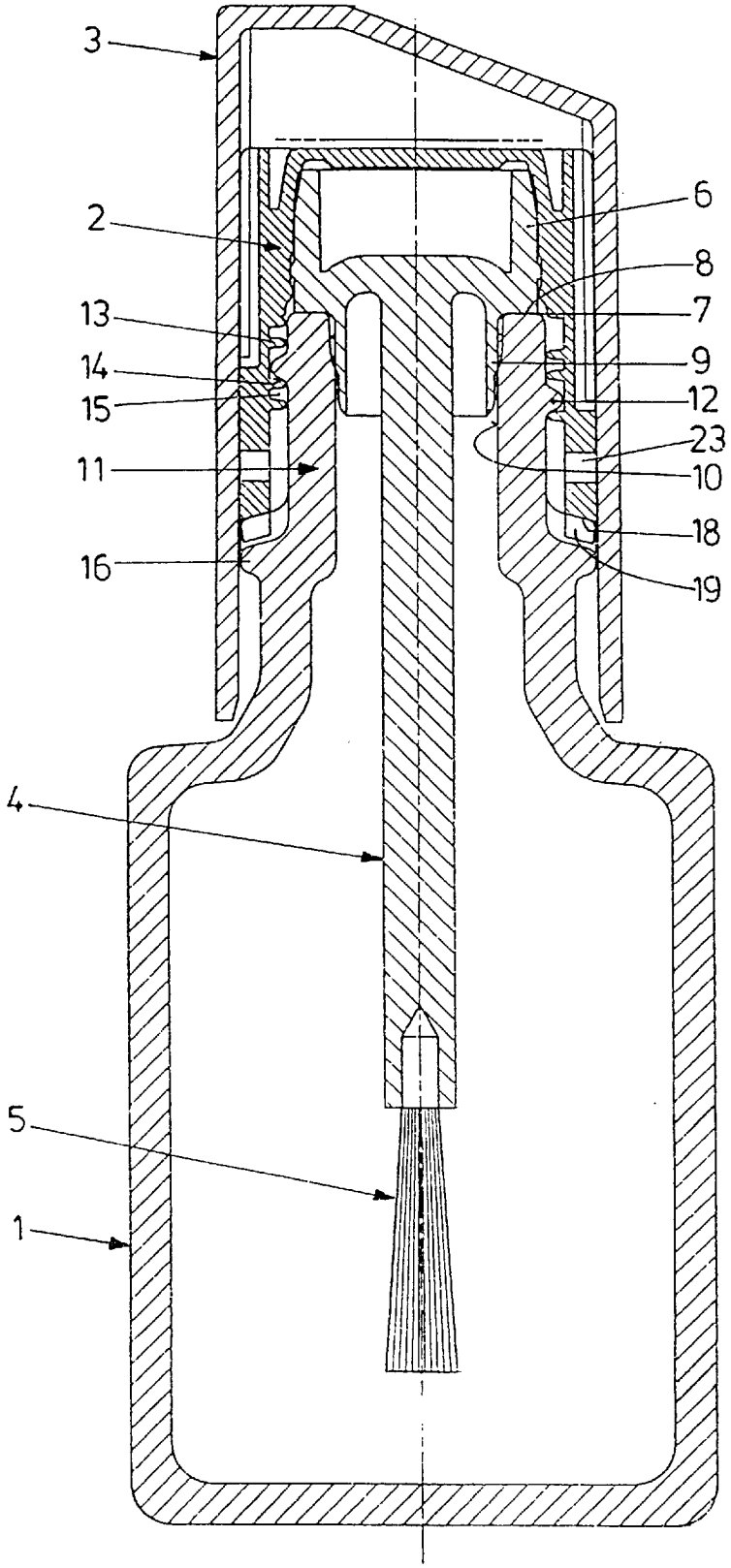
FIG. 1 is a section through a screw cap reservoir according to the invention.

FIG. 1 illustrates a reservoir 1 in the form of a glass bottle for nail enamel, which can be closed by a screw cap 2, a slip-on cap 3 being pushed on the actual screw cap 2 and determining the outer appearance.

A handle 4 of an applicator 5 in the form of a brush is inserted into the interior of the screw cap 2, the upper end of the handle 4 forming one piece with a retaining attachment 6 that is locked into place inside the screw cap 2. A sealing face 8 of the retaining attachment 6 rests plane on the front 7 of the reservoir 1, a sealing cone 9 being provided additionally, which reaches into the reservoir mouth, resting sealingly on the mouth inside wall 10.

The neck 11 of the reservoir 1 has an external thread 12 cooperating with the internal thread 13 of the screw cap 2.

The internal thread 13 of the screw cap 2 is such that the flanks 14 are provided with a groove 15, which virtually divides the flanks of the thread, thus ensuring that the flanks 14 are slightly flexible in order to compensate for tolerances.

Figure 2:
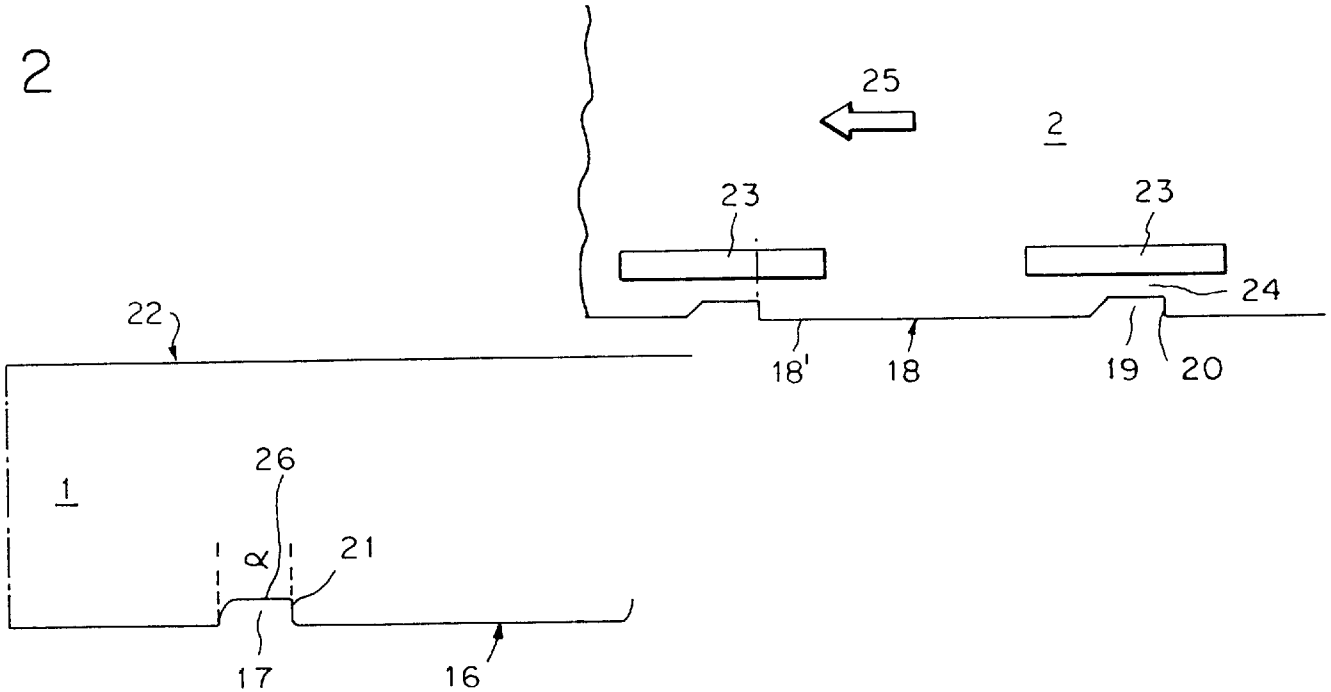
FIGS. 2 to 4 show different embodiments of the layouts of the lower edge of the screw cap and of the contour of the bottle neck, respectively.

FIG. 2 shows a lower portion of screw cap 2 moving in the direction of arrow 25 clockwise over an upper portion of reservoir 1 to a point of final closure. To open the reservoir 1 cap 2 is turned counter-clockwise in the direction opposite to arrow 25.

The neck 11 has an encircling shoulder 16, which possesses at least one stop 17 in the form of a projection 17—projecting axially upwards from the shoulder in the embodiment according to FIG. 2. The projection 17 extends over an angle at circumference α.

The lower edge 18 of the screw cap 2 is provided with corresponding stop recesses 19, a section 20 of these recesses 19 extending approximately at right angles to the lower edge 18 and bearing against a corresponding right-angle flank 21 of the projections 17 in the screwed-on final condition. FIG. 2 illustrates the thread pitch 22 of the internal thread 13 and the external thread 12, respectively.

In the area above the lower edge 18 of the screw cap 2 above each stop recess 19, a slit-type recess 23 is provided, overlapping the latter and ensuring that the web portion 24 above each recess 19 can yield flexibly in when screw cap 2 to is turned the direction of the arrow 25 during the screw-on process, i.e. when the lower edge 18 of the screw cap 2 contacts the upper side 26 of the stop projections 17, so that subsequently audible and tangible snap-engagement clicks will take place when the final position is reached.

With a view to achieving a soft snap-on process, the portion 18' of the lower edge 18, which will first contact the upper side 26 of the stop projections 17, is inclined in the direction of the thread pitch 22, the inclination corresponding approximately to the thread pitch 22.

Figure 3:
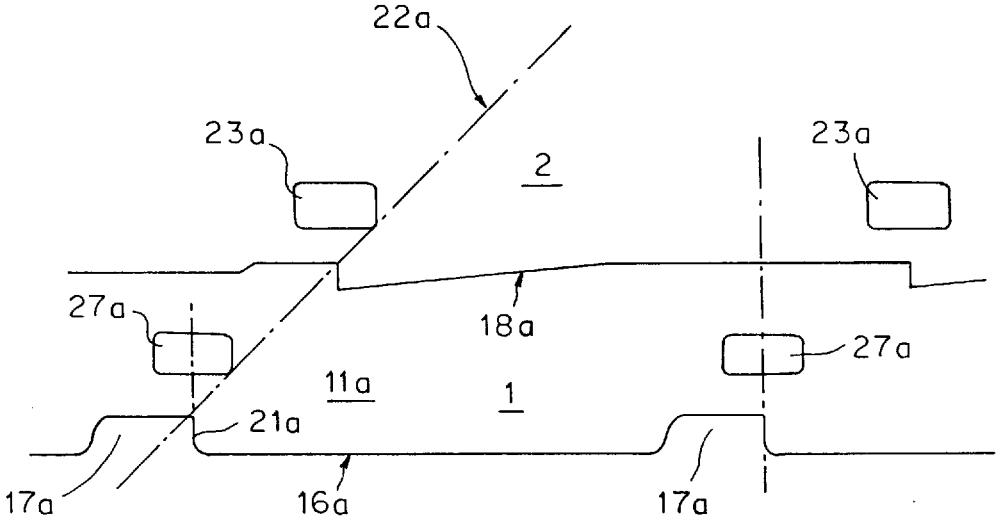

In the modified embodiment according to FIG. 3 which similar to FIG. 2 shows portions of cap 2 being turned on reservoir 1, the encircling and after "16*a*" insert of neck 11 shoulder 16*a* is like-wise provided with stop projections 17*a* projections 27*a*, which project radially outwards from the neck 11*a*, are located above the stop projections 17*a* approximately in the vicinity of the stop shoulder 21*a*. The thread has a steeper pitch 22*a* and during the screwing-on operation, the recesses 23*a* provided in the portion above the lower edge 18*a* come to lie above the projections 27*a*, which extend into the recesses. As can be seen from the drawings, in both the embodiments of FIGS. 2 and 3, the screw cap 2 is unscrewed using an increasing amount of force to overcome the engagement of the stop recess and stop projection.

Figure 4:
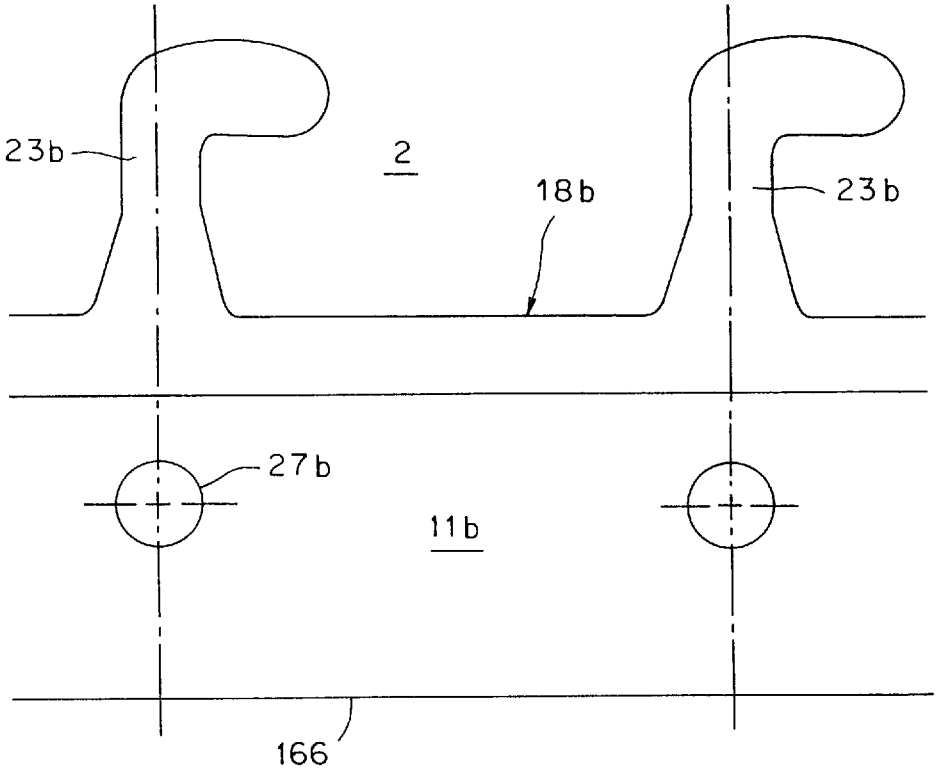

In the variant shown in FIG. 4 again showing portions of cap 2 and reservoir 1, the shoulder 16*b*, respectively, is no longer provided with stop projections 17 or 17*a* as in FIGS. 2 and 3, but round, pin-type projections 27*b* project from the bottle neck 11*b* radially outwards.

The lower edge 18*b* of the screw cap 2 is provided with recesses 23*b*, which are L-shaped and open towards the lower edge 18*b*, so that they cooperate with the radial projections 27*b* in the way of a slide lock when the cap is screwed on.

What is claimed is:

1. A combination of a screw cap and a reservoir for a cosmetic, wherein the screw cap is engageable to the reservoir for a cosmetic, said reservoir comprising a neck having an external thread on which to screw an internal thread of the screw cap, an encircling shoulder formed on the neck below the external thread, said encircling shoulder having at least one stop in the form of a first stop projection which extends over an angle α around a circumference of the shoulder and projects upwards from the shoulder, said screw cap comprising at least one first stop recess on a lower edge thereof which snap engages and creates an audible click with said first stop projection when the screw cap is screwed on said reservoir, said stop recess being arrested in a defined final position by said first stop projection, wherein in a portion approximately above each stop recess (19), a peripheral surface of the screw cap (2) is provided with a second recess (23) projecting into a thickness of the wall, said second recess yielding when said screw cap is turned to said final position.

2. The combination accordingly to claim 1, wherein the second recess (23) is a slit spaced above the stop recess (19) in a circumferential direction.

3. The combination according to claim 1, wherein a portion (18') of the lower edge (18) of the screw cap (2) which contacts an upper side (26) of the stop projection (17) of the reservoir (1) when the screw cap is screwed on the reservoir is inclined in the direction of a thread pitch (22) of said external thread and said internal thread.

4. The combination according to claim 3, wherein the portion (18') has an inclination corresponding to the thread pitch (22).

5. The combination according to claim 1, wherein at least part of a flank (14) of the internal thread (13) of the screw cap (2) is flexible in such a way that a groove (15) will extend radially inwards from a crest of a respective turn, making the flank (14) resilient.

6. The combination according to claim 1, an applicator is provided that has a handle and a retaining attachment snap-engaged with the screw cap, wherein the retaining attachment (6) is provided with a lower annular shoulder (7) so that upon snap-engagement of the first stop recess (19) with the first stop projection (17), the shoulder (7) rests against a front (8) of a mouth of the reservoir (1), to form a seal between the shoulder (7) and the reservoir (1).

7. The combination according to claim 1, wherein at least one second stop projection (27*a*) is provided on the reservoir neck (11), which projects from the neck radially outwards and which engages with the second recess (23*a*) in the closing direction, wherein when said screw cap is turned to said final position an audible click is created by said second recess (23*a*) engaging said second stop projection.

8. The combination according to claim 7, wherein the combination has more than one second stop projection.

9. The combination according to claim 1, wherein the combination has more than one first stop projection, first recess and second recess.

10. The combination of claim 1, wherein the second recesses extend through the thickness of the wall.

* * * * *